US007806490B1

(12) United States Patent
Buehl

(10) Patent No.: US 7,806,490 B1
(45) Date of Patent: Oct. 5, 2010

(54) PANEL MOUNTED APPLIANCE ELEVATOR APPARATUS

(75) Inventor: Robert C. Buehl, Boca Raton, FL (US)

(73) Assignee: ImportAdvantage, Inc., Boca Raton, FL (US)

( * ) Notice: Subject to any disclaimer, the term of this patent is extended or adjusted under 35 U.S.C. 154(b) by 658 days.

(21) Appl. No.: 11/456,311

(22) Filed: Jul. 10, 2006

(51) Int. Cl.
*A47B 51/00* (2006.01)

(52) U.S. Cl. ..... 312/312; 312/21; 312/319.5

(58) Field of Classification Search ..... 312/7.2, 312/312, 319.8, 208.1, 223.3, 319.5, 306, 312/247, 21; 108/147, 50.02
See application file for complete search history.

(56) References Cited

U.S. PATENT DOCUMENTS 1,829,359 A * 10/1931 Kittredge ..... 312/10.1
2,738,248 A * 3/1956 Berker ..... 312/29
4,151,804 A 5/1979 Wache et al.
4,568,132 A * 2/1986 Watt ..... 312/312
4,894,600 A 1/1990 Kearney
5,083,514 A * 1/1992 Schwartz et al. ..... 108/147
5,129,611 A 7/1992 Grover et al.
5,289,782 A 3/1994 Rizzi et al.
5,370,063 A 12/1994 Childers
5,401,089 A * 3/1995 Inagaki et al. ..... 312/7.2
5,797,666 A 8/1998 Park
5,845,590 A 12/1998 Seidl
5,927,835 A * 7/1999 Mergold et al. ..... 312/235.3
6,073,892 A 6/2000 Dittmer
6,148,741 A 11/2000 Motta
6,471,311 B1 * 10/2002 Snyder ..... 312/247
6,494,150 B1 12/2002 Phoenix et al.
6,612,670 B2 9/2003 Liu
6,733,094 B1 5/2004 Chang
6,902,243 B2 6/2005 Bober
6,997,525 B2 * 2/2006 Gillengerten ..... 312/7.2
7,043,810 B2 5/2006 Bober
7,044,423 B2 * 5/2006 Bober et al. ..... 248/188.4
7,207,278 B2 * 4/2007 Latino et al. ..... 108/50.01
2004/0164659 A1 * 8/2004 Bober ..... 312/312
2005/0275323 A1 * 12/2005 Wilhelm ..... 312/319.5
2006/0238086 A1 * 10/2006 Lai ..... 312/319.5
2006/0255697 A1 * 11/2006 Smieszek et al. ..... 312/21
2007/0040482 A1 * 2/2007 Williams ..... 312/21

* cited by examiner

*Primary Examiner*—Janet M Wilkens
(74) *Attorney, Agent, or Firm*—GrayRobinson, P.A.

(57) ABSTRACT

An appliance elevator includes a lift mechanism mounted to a substantially planar mounting panel at least a portion of which extends beyond the body of the lift mechanism to provide an area by way of which the mounting panel and lift mechanism pre-mounted on the mounting panel can be easily positioned within a piece of furniture and attached to the furniture by way of one or more fasteners such that substantially the entire mechanical load on the lift mechanism when it is in use is transferred to the furniture by way of the mounting panel.

13 Claims, 5 Drawing Sheets

PANEL MOUNTED APPLIANCE ELEVATOR APPARATUS

CROSS-REFERENCE TO RELATED APPLICATIONS

Not Applicable.

STATEMENT REGARDING FEDERALLY SPONSORED-RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention relates to the field of furniture making. More particularly, the invention relates to a panel-mounted elevator apparatus installable within a piece of furniture for supporting a household or office appliance, such as a television, television monitor, computer monitor or the like, and for selectively raising the appliance from within the furniture for use and lowering the appliance into the furniture for storage when the appliance is not in use.

BACKGROUND OF THE INVENTION

It has become popular in recent years to manufacture home and office furniture items which include an internally mounted, power-driven elevator for supporting an appliance such as a television, television monitor, computer monitor or the like supporting an appliance, such as a television, television monitor, computer monitor or the like, and for selectively raising the appliance from within the furniture for use and lowering the appliance into the furniture for concealment when the appliance is not in use. Furniture incorporating such elevators is popular for use with large screen televisions such as those having plasmas or liquid crystal screens which are relatively thin. The elevators are typically electrically powered and are controlled by way of a manual switch mounted on or in the furniture and/or by a convenient handheld remote control unit, such as an infrared type, operable from some distance away. Furniture mounted appliance elevators having lift mechanisms using various types of drive units mechanically interposed between an electrical drive motor and an appliance support platform are known in prior art.

For example, U.S. Pat. No. 4,151,804 to Wache discloses an elevator in which a horizontal television support is vertically driven between raised and lowered positions by a threaded ball bearing nut threaded which engages a single, vertically-oriented, threaded rod which is rotatably driven by a belt drive train connected to an electric motor. In U.S. Pat. No. 6,494,150 to Phoenix et al. an elevator for a visual display includes a support connected at each end to one of a pair of threaded nuts. Each of the nuts engages a respective one of a pair of threaded vertical rods which are synchronously driven by a single electric motor coupled to both rods through a gear drive mechanism. The lifting mechanism disclosed in U.S. Pat. No. 6,733,094 to Chang also uses a pair of threaded vertical rods which engage correspondingly-threaded ends of a traverse bar that supports the screen to be lifted but uses a belt drive rather than a gear drive to rotate the threaded rods.

U.S. Pat. No. 5,129,611 to Grover et al. discloses a television display stand having intermediate and upper frames which telescope to extend vertically from the interior of a base frame by means of a series of pulleys engaging a cable wound about a rotatable capstan coupled to an electric motor through pair of bevel gears.

U.S. Pat. No. 6,612,670 to Liu discloses a screen elevating mechanism having a pair of vertical slide assemblies disposed between a of pair mutually-spaced, horizontal, traverse rods, the lower one of which is rotatable by means of a hand crank. Each slide assembly includes a transmission belt looped around the traverse rods and a screen bearer connected to each belt so that the screen bearers may be raised or lowered as the crank is turned manually.

U.S. Pat. No. 5,797,666 to Park describes a desk with a liftable monitor case. In one embodiment, the monitor case is lifted by a pantographic mechanism which is extended, to raise the monitor case, by drawing the ends of a pair of arms toward one another and retracted, to lower the monitor case, by moving those ends apart. To do so, and end of one of the arms is coupled to a nut bracket which engages a screw shaft driven by a reversible electric motor. In an alternative embodiment, the monitor case is driven by a rope and pulley mechanism.

Television elevator mechanisms which include four elongated racks, one of which is mounted in a vertical orientation at each of the four vertical corners of a parallel-piped shaped piece of furniture, are also known in the prior art. A horizontal shelf for supporting the television is supported at each of the four corners by a power-driven pinion gear which engages a respective one of the racks to vertically raise or lower the shelf, depending on the direction of rotation of the pinions.

The furniture industry is intensely competitive and cost sensitive. A shortcoming the prior art lift mechanisms described above is that each requires significant assembly in-situ within the piece of furniture in which it is to be installed. The time required to carry out such an assembly within the limited space available inside the furniture is not insubstantial and can significantly increase the labor costs borne by the furniture manufacturer. Those labor costs are increased, not only because of the actual time required to perform the assembly inside the furniture, but also by the necessity of having the work performed by installers having significant skill and training as well as manual dexterity. Installation skill and training specific to each particular type of lift mechanism used by the furniture manufacturer is required. Thus, training costs are multiplied if the furniture manufacturer uses several different types of lifts. The cost and time required to train installers limits the flexibility of furniture manufacturers to substitute lifts of one type for another or to begin use lifts of a different type in order to take advantage of lower prices, better quality, design improvements or more reliable sources of supply.

One prior art attempt to overcome such shortcomings is exemplified by U.S. Pat. Nos. 6,902,243 and 7,043,810 to Bober. That patent mounting a lift and its associated control module inside, and fastened to, a box-like sub-cabinet having at least three panels perpendicularly disposed about a floor panel. The sub-cabinet/lift/control module sub-assembly can then readily be inserted as a unit into a larger, decorative cabinet or other item of furniture. This arrangement simplifies installation and reduces installation time and cost by allowing the lift and its control module to be assembled and installed within the sub-cabinet before the sub-cabinet is inserted into the furniture. Being open on one or two sides, the sub-cabinet is less restrictive of the installer's reach and movements than the furniture into which the sub-assembly is subsequently inserted. The completed sub-assembly can be supplied to furniture manufacturers as a unit which can easily be inserted into a piece of furniture by workers having no special skill or training in assembling or wiring lift mechanisms. The mechanical details of the lift mechanism thus become largely irrelevant to the installation process thus permitting installation to be carried out by relatively unskilled workers. However, this approach has a number of significant drawbacks and limitations.

A sub-cabinet having at least three panels perpendicularly disposed about a floor panel, as taught by Bober '243 and Bober '810, occupies significant volume and is significantly heavier than a lift mechanism and its associated controls alone. Shipping completed lift/sub-cabinet/control module assemblies from a lift manufacturer to a furniture manufacturer therefore would entail significantly increased shipping expenses which would tend to erode, if not completely offset, the installation cost savings potential described above. Such sub-cabinets must also be of a 3-dimensional size compatible with the furniture in which they are to be installed. Ideally, the sub-cabinet would be only slightly smaller than the inside dimensions of a particular piece of furniture so to waste as little interior furniture space as possible. If so dimensioned for once particular piece of furniture, the same sub-cabinet would not fit inside a significantly smaller piece of furniture. Conversely, using the same sub-cabinet in a significantly larger piece of furniture would result in a significant waste of interior furniture space. Indeed, even under the ideal circumstance, a significant amount of interior furniture space would necessarily be lost owing simply to the thickness of the panels and floor forming the sub-cabinet. The material cost and assembly cost of the three or more panels which form the sub-cabinet is also commercially significant.

SUMMARY OF THE INVENTION

In accordance with the invention, the above-noted drawbacks and disadvantages of the prior art are overcome by providing an appliance elevator apparatus having an appliance lift mechanism which, prior to installation in a piece of furniture, is mounted to a substantially planar mounting panel which defines a mounting plane oriented substantially parallel to the line of travel of the lift mechanism. At least a portion of the mounting panel extends beyond the periphery of the body of the lift mechanism in at least one direction oriented substantially perpendicular to the line of travel. To facilitate handling of the lift mechanism, this extending portion of the mounting panel optionally includes one or more hand openings of sufficient size to permit the mounting panel and lift mechanism mounted thereon to be easily grasped and maneuvered into position as a unit within the interior cavity of the furniture in which the apparatus is to be installed. The extending portion of the mounting panel also provides an area readily accessible to installation personnel by way of which the mounting panel and lift mechanism pre-mounted on the mounting panel can be rapidly and easily positioned within the interior cavity of the furniture and, once positioned fastened to the furniture by way of one or more fasteners attaching the extending portion of the mounting panel to the furniture such that substantially the entire mechanical load on the lift mechanism when it is in use is transferred to the furniture by way of the mounting panel. Moreover, such installation can readily be carried out by a single person. The mounting panel thus facilitates both installation and pre-installation handling and provides for efficient and structurally sound installation of the lift mechanism within the furniture while dispensing with the need for additional substructure panels which add weight, waste space within the furniture, add unnecessary cost and limit options for installation in multiple sizes of furniture.

DESCRIPTION OF A PREFERRED EMBODIMENT

Figure 1:
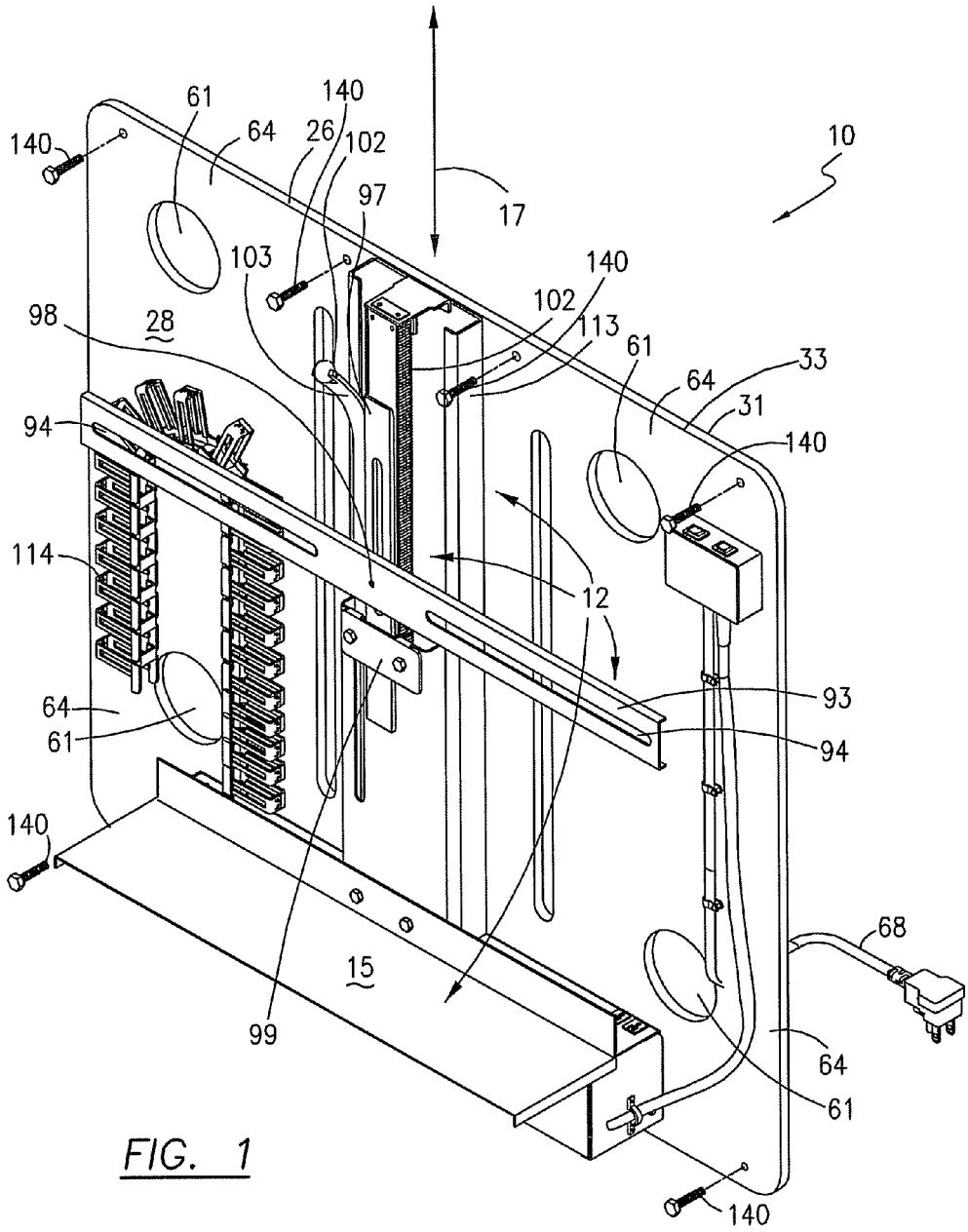
FIG. 1 is a perspective view of a preferred embodiment of a panel mounted appliance elevator according to the present invention shown assembled, with its appliance support positioned in a lowered, storage position, ready for mounting within the interior cavity of a piece of furniture.
Figure 2:
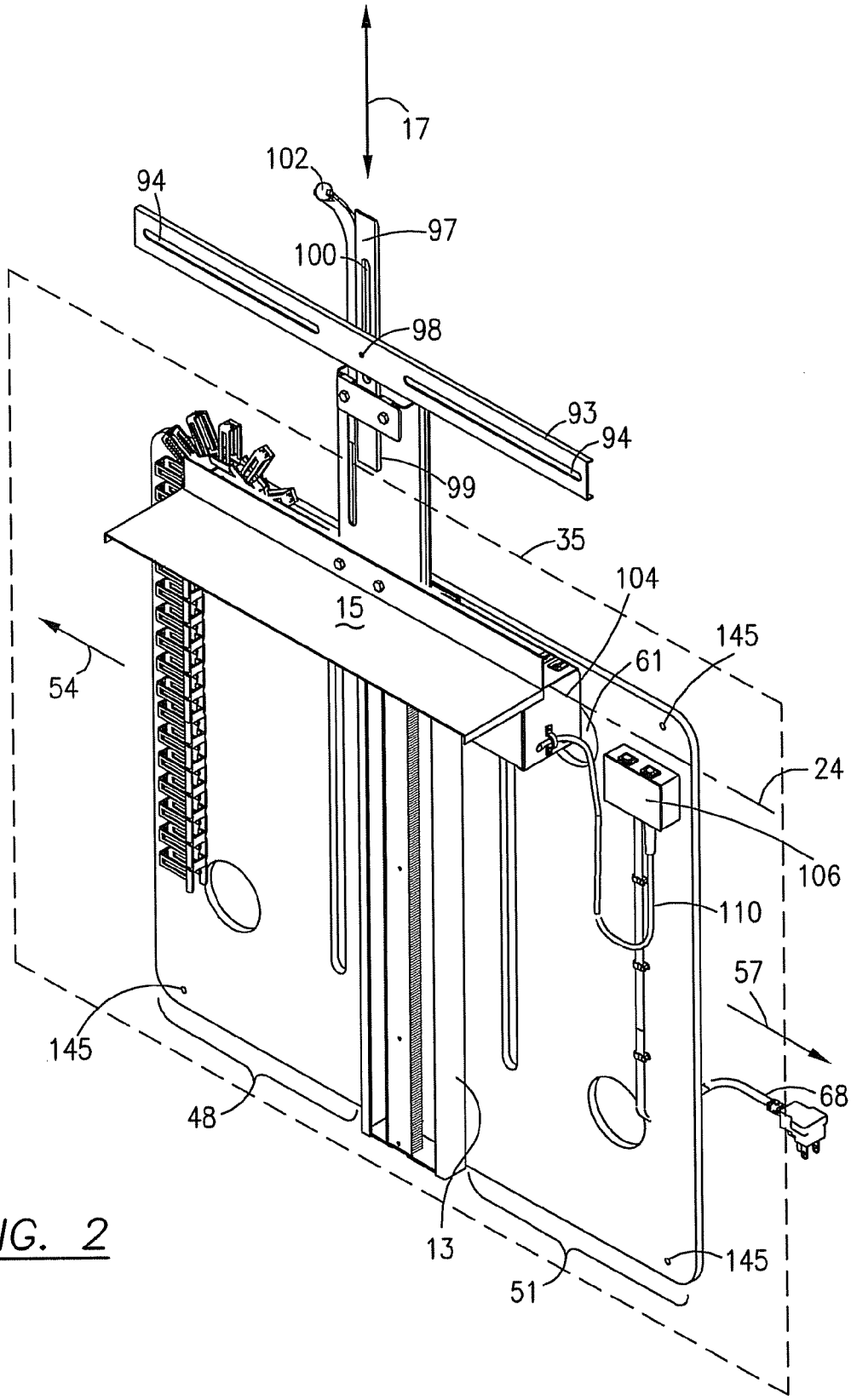
FIG. 2 is a perspective view showing the appliance elevator of FIG. 1 with its appliance support in a raised, use position.

FIGS. 1-7 illustrate a preferred embodiment of a panel-mounted appliance elevator 10 constructed according to the present invention. Elevator 10 includes a power-driven lift mechanism 12 which has a stationary body 13 to which a movable appliance support 15 is mounted for holding a television or other household appliance (not shown). Lift mechanism 12 includes an electric motor 14 and a drive unit 16 which is mechanically interposed between the motor and the appliance support to selectively move the appliance support 15, and thus the appliance it carries (not shown), along a line of travel 17 between a lowered, storage position 19, as shown in FIG. 1, for storing the appliance concealed within the interior cavity 20 of a piece of furniture 22 within which elevator 10 is installed, and a raised, use position 24, as shown in FIG. 2 for making the appliance accessible for its normal intended use.

Figure 3:
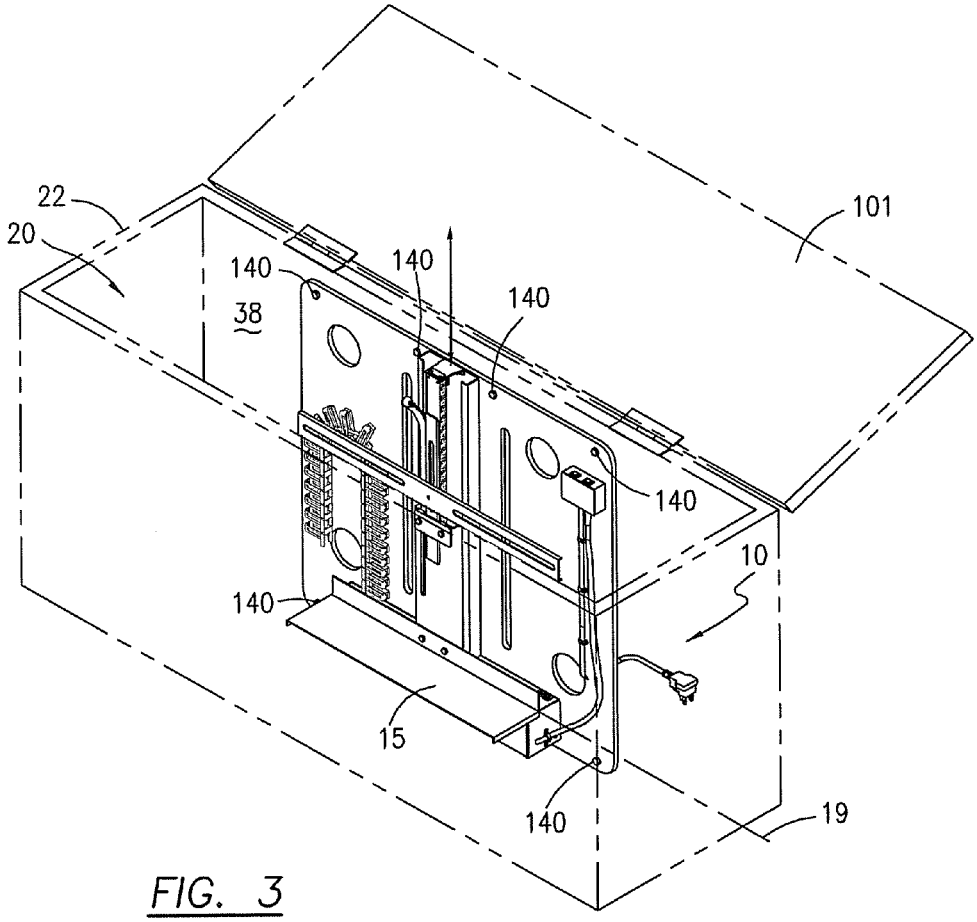
FIG. 3 is a perspective view showing the appliance elevator of FIGS. 1 & 2 installed within the interior cavity of a piece of furniture.
Figure 4:
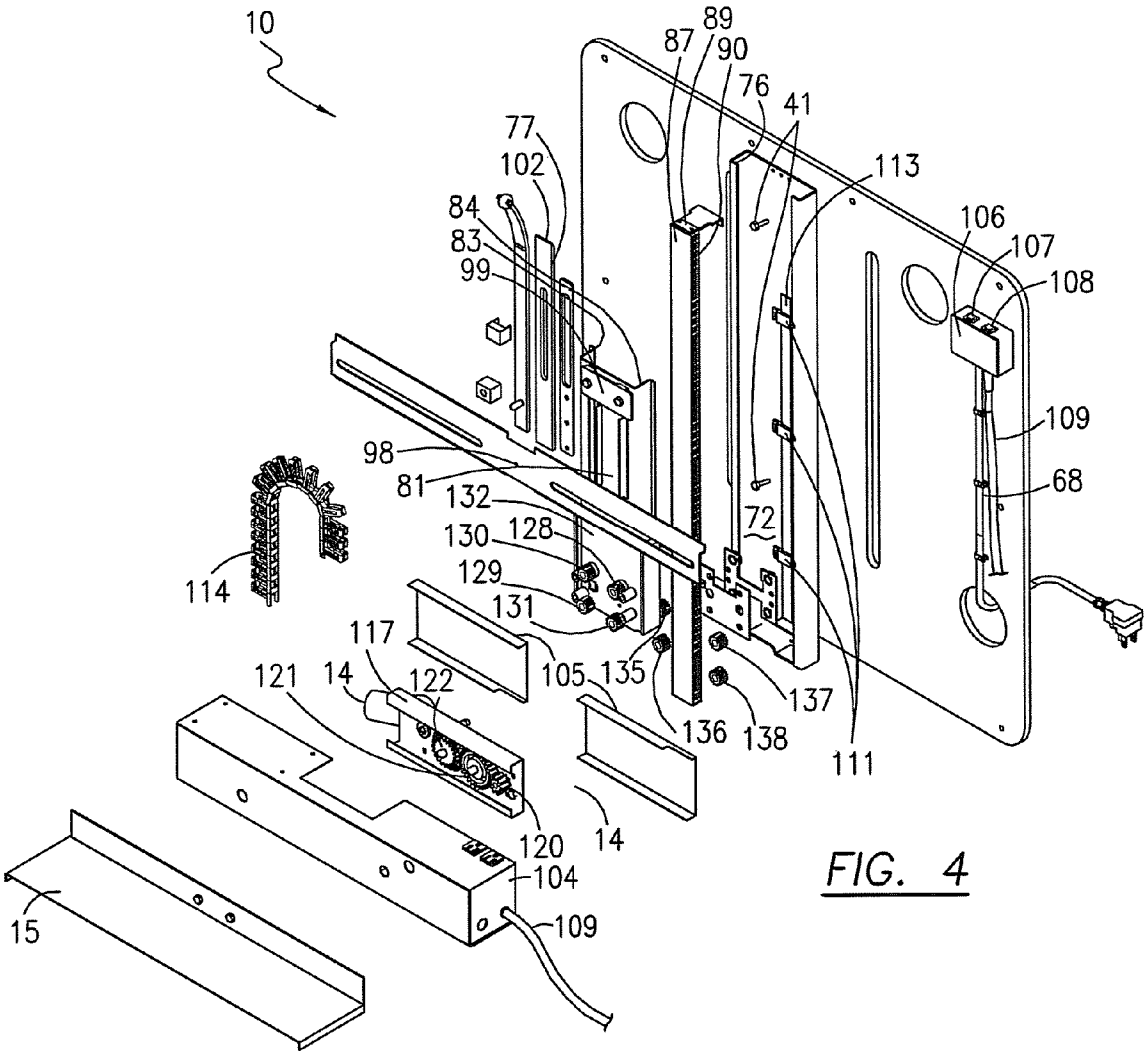
FIG. 4 is an exploded, perspective view of the appliance elevator of FIGS. 1, 2 & 3.

In accordance with the invention, the body 13 of lift mechanism 12 is mounted upon a substantially planar mounting panel 26. Mounting panel 26 has a front surface 28 and an opposed rear surface 31 which defines a mounting plane 35. Upon installation of elevator 10 within furniture 22, mounting plane 35 will typically be oriented vertically, lying either directly against or closely adjacent to the inside of the rear vertical wall 38 of the item of furniture 22 as shown in FIG. 3. As shown in FIG. 1, mounting panel 28 includes an outer edge 33 located between front surface 28 and rear surface 31.

Prior to installation of appliance elevator 10 within furniture 22, lift mechanism 12 is attached to the mounting panel 26. In particular, the body 13 of lift mechanism 12 is attached in positionally-fixed relation to mounting panel 26 in an orientation such that the line of travel 17 of appliance support 15 is oriented substantially parallel to mounting plane 35. The body 13 of lift mechanism 12 can, if desired, be attached in direct contact with the front surface 28 of mounting panel 26. Alternatively, the body 13 of lift mechanism 12 can be attached to lie spaced away from the front surface 28 of mounting panel 26 by way of one or more intermediate elements such as spacers, shims, washers, bushings, or the like (not shown). In either case, the body 13 of lift mechanism 12 can be secured to mounting panel 26 using at least one screw or other fastener 41. Preferably, elevator 10 is supplied to the manufacturer of furniture piece 22 in a substantially fully assembled faun with lift mechanism 12 substantially fully assembled and its body 13 already affixed to mounting panel 26.

Panel 26 may be formed of any suitably strong and rigid material capable of supporting lift mechanism 12. Preferably, mounting panel 26 should be sufficiently strong to bear and the entire mechanical load imposed by the full combined weight of not only lift mechanism 12 itself but also the expected maximum weight of the television or other appliance(s) to be supported by lift mechanism 12, and to transfer that load to appropriately strong members of the piece of furniture 22 in which elevator 10 will ultimately be installed. While plywood or MDF are considered ideal in view of their excellent mechanical properties, low cost and wide availability, mounting panel 26 could also suitably formed of other materials including thermoplastic, thermosetting or composite materials from which panel 26 may either be custom molded or fabricated from pre-formed sheet stock. In the preferred embodiment illustrated in FIGS. 1-7, mounting panel 26 is formed of a square or rectangular piece of unitary sheet material such as plywood or medium density fiber board, commonly referred to as "MDF", of ½ inch or ¾ inch nominal thickness. Mounting panel 26 must be of overall height and width dimensions which are sufficiently small to allow appliance elevator 10 fit within the interior cavity 21 of each particular model of furniture 22 within which appliance elevator 10 is desired to be mounted. In lieu of unitary sheet material, mounting panel 26 could also be fabricated by joining together a plurality of discrete elongated members to form an open panel structure.

The height of the mounting panel 26 may, if desired, be shorter than the overall height of lift mechanism 12 when lift mechanism 12 is in its storage position 19. Alternatively, provided it is not so high as to be precluded from fitting within the interior cavity of a given piece of furniture 22 in which elevator 10 is to be installed, mounting panel 26 can be of a height which is shorter than the overall height of lift mechanism 12 in its lowered position 19. As to its width dimensions, the invention contemplates that at least a portion of mounting panel 26 is wider than the body 13 of the lift mechanism 12 so that at least a portion of mounting panel 26 extends beyond the body 13 of the lift mechanism 12 in at least one direction substantially perpendicular to line of travel 17. As shown in FIG. 2, the mounting panel 26 in the preferred embodiment includes two such portions 48, 51 located on opposite sides of the body 13 of lift mechanism 12. Portion 48 extends in a leftward direction 54 for some distance laterally past the left-most edge of body 13. Portion 51 extends for some distance beyond the right-most edge of body 13 in a rightward direction 57.

Advantageously, extending portions 48 and/or 51 may be provided with one or more hand openings 61 located sufficiently near an outer edge of mounting panel 26 as to define an adjacent handle portion 64. Hand openings 61 may also serve as passages for routing cables such as an AC power supply cable 68. Openings 61 also reduce the overall weight of mounting panel 26 to reduce shipping costs.

The body 13 of lift mechanism 12 may suitably be formed from a fabricated or extruded or length of heavy gauge steel channel stock of substantially C-shaped cross-section. Body 13 has a rear wall 72 and a pair of mutually-spaced, flat vertical rails 76, 77. Body 13 is preferably laterally centered on mounting panel 22 and is secured to mounting panel 22 by bolts and nuts or screws 41 penetrating rear wall 72. Rails 76 and 77 are oriented vertically, parallel to the desired line of travel 17 of lift mechanism 12. A slide plate 81 includes elongated vertical edges 83 and 84. Edges 83 and 84 are captured inside body 13 in direct facial engagement with the inner surfaces of rails 76 and 77, respectively to permit vertical movement of slide plate 81 along line of travel 17 while prohibiting significant movement slide plate 81 in any other direction. An elongated rack 87 having mutually-opposed toothed faces 89 and 90 is supported between the rear wall 72 of body 13 and slide plate 81 such that toothed faces 89, 90 are oriented parallel to line of travel 17.

Appliance support 15 is bolted or otherwise securely attached to the lower end of slide plate 81. In the preferred embodiment appliance support 15 takes the form of an extruded, stamped or fabricated sheet metal trough of generally L-shaped cross-section positioned as shown in FIGS. 1 & 2 to provide a horizontal surface for supporting an appliance. To secure an appliance such as a television to appliance support 15, and to prevent the appliance from tipping over, left mechanism 12 also preferably includes a horizontal support bar 93 having slots 94 through which the appliance can be bolted or otherwise suitably attached to the support bar 93. The support bar 93 is attached to the upper end of slide plate 81 by way of a vertical arm 97 so as to move as a unit with the appliance support 15 and the appliance it carries. To permit the height of arm 97 and bar 93 to be adjusted, arm, 93 is releasably clamped to slide plate 81 by way of a clamping plate 99 which is bolted or otherwise releasably attached to slide plate 81. Arm 97 preferably includes a vertical slot 100 through which horizontal support bar 93 is attached by means of a threaded stud 98 which receives a nut (not shown) such as a wing nut which can readily be loosened and re-tightened by hand in order to allow further adjustment of the height of support bar 93. When elevator appliance 10 is installed in a piece of furniture 22 having a hinged top 101 as illustrated in FIG. 1, the height of arm 97 is preferably adjusted to extend just above the top of the appliance carried by appliance support 15. Doing so allows arm 97 to push open the hinged top 101 as appliance support 15 moves from the storage position 19 to the raised use position 24. To prevent marring of the interior surface of the hinged top 101 of furniture 22 as a result of such opening, the upper, free end of slide plate 81 preferably carries an adjustable, vertical arm topped with a non-marring plastic roller 102. The height of arm 103 is adjusted to be sufficiently low that roller 102 lies below the hinged top 101 of furniture 22 when appliance support 15 is in its storage position 19. At the same time, the height of arm 103 is adjusted to be high enough that as appliance support 15 is raised, roller 102 makes contact with the interior surface of hinged top 101 before hinged top 101 is contacted by any other member associated with appliance elevator 12 or the appliance it carries, and pushes hinged top 101 open as appliance support 15 is raised from the storage position 19 to the use position 24.

Also secured to the lower portion of slide plate 81 is an electrical enclosure 104 which is preferably formed of steel or other metal sheet material. Electrical enclosure 104 is located immediately beneath appliance support 15 and includes a pair of removable rear covers 105. Electrical enclosure 104 houses motor 14 as well as most of the electrical and electronic components associated with the control of motor 14. Such controls are well-known in the art and therefore will not be described in great detail. Such controls may optionally include a receiver circuit which includes sensor or antenna responsive to receive infra-red (IR) or radio frequency (RF)

control signals generated by a handheld remote control unit (not shown). As is known in the art, such a remote control unit can be used to selectively energize and de-energize motor 14 and control its direction so as to either raise or lower appliance support 12. In order to do so manually, a switch box 106 having an "on-off" switch 107 and an "up-down" switch 108, such as a momentary rocker switch, is attached near the top of mounting panel 26 in a location readily accessible to a user after appliance elevator and has been installed in furniture 22. A.C. power cable 68 is routed to switch box 106 which is in turn electrically connected to electrical enclosure 104 by way of a flexible, multiple conductor power and control cable 110. One or more limit switches or proximity switches (not shown) are also typically provided in order to stop motor 14 when appliance support 15 reaches use position 24 and storage position 19, respectively. Such limit switches or proximity switches operate in response to sensing the position of one or more stops 111. Stops 111 are mounted along a vertical track 113 secured to the rear wall 72 of body 13 such that the vertical position of each stop 111 can be adjusted. By so doing, the heights of the storage position 19 and use position 24 of the appliance support 15 can be adjusted to suit the needs of a particular application. Conventionally, the controls associated with lift mechanism 12 also include over-current protection such as fuses and/or circuit breakers, as well as thermal protection for motor 14. It is also conventional for such controls to include some form of emergency stop switch which is easily accessed and can be actuated quickly to immediately stop and/or reverse the travel of appliance support 15 in the event of an emergency. Various forms of such emergency controls are well known in the art and therefore are also not described here in further detail.

Appliances such as televisions typically require a plurality of cables connected between the rear of the appliance and external devices such as antennae, cable television boxes, digital video disk (DVD) players, video cassette recorders (VCR's) or the like. To prevent such cables from being damaged and/or jammed in appliance elevator 10 as appliance support 15 moves, it is desirable to provide lift mechanism 12 with a flexible cable management channel 114 through which such cables can be safely routed. Since cable management channels 114 of the type shown in FIGS. 1 & 2 are well known and readily commercially available, it is unnecessary to describe their structure in detail. As shown in FIGS. 1 & 2, one end of the cable management channel 114 is attached adjacent one of the openings 61 which may conveniently serve as a cable passageway. The opposite end of cable management channel 114 is connected to electrical enclosure 104 so that it may move together with appliance support 15.

Figure 5:
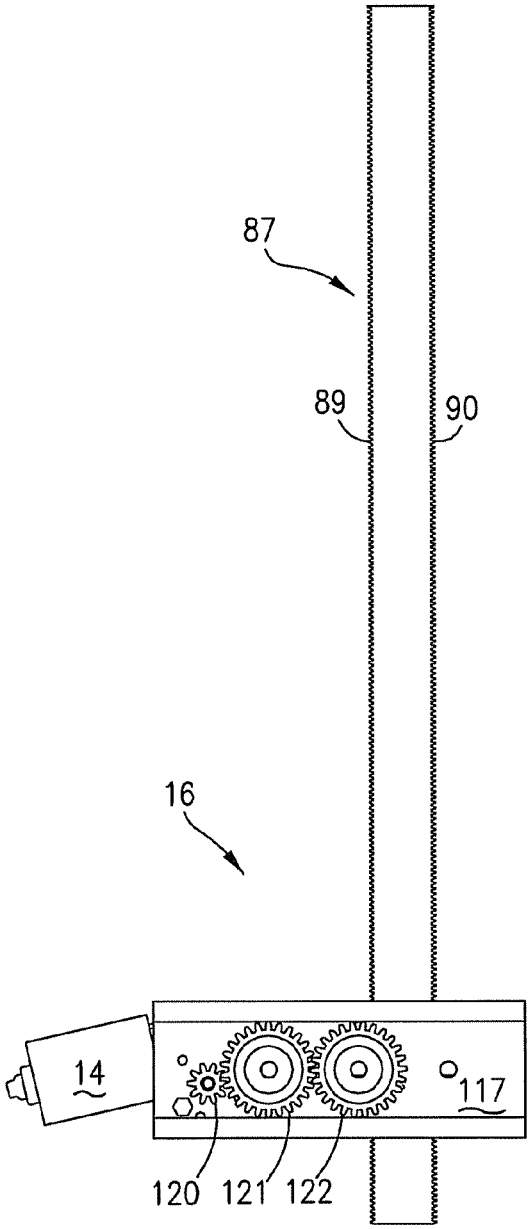
FIG. 5 is a front view showing the first stage of the gear train of the drive unit of the appliance elevator of FIGS. 1, 2 & 3.

As shown in FIGS. 4-7, motor 14 may suitably take the form of an electric gear motor which is mounted, by way of its gear case 115, to a gear support 117 formed from a length of steel C-channel stock which has been drilled and fitted with bearings at appropriate locations. As best seen in FIG. 5, the output shaft of gear case 115 is connected to a first stage of the gear train of drive unit 16. The first stage includes a pinion 120 which drives a larger gear 121 which itself drives a gear 122 of the same pitch diameter as gear 121. The first stage of the gear train of drive unit 16 is coupled to a second stage thereof.

Figure 6:
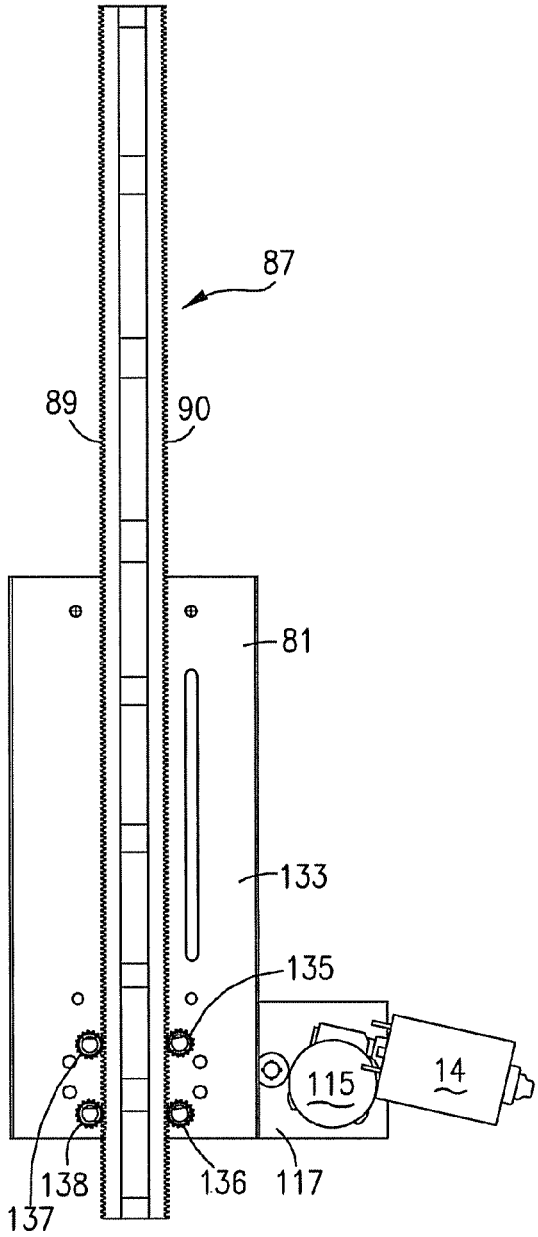
FIG. 6 is a rear view showing the second stage of the gear train of the drive unit of the appliance elevator of FIGS. 1, 2 & 3.

As shown in FIG. 6, the second stage of the gear train of drive unit 16 is mounted on the face of gear support 117 lying opposite the face thereof to which the first stage is mounted. The second stage 125 includes a gear 126 which has a shaft common to that of gear 122, and a meshing gear 127 having a shaft common to that of gear 121. Gear 126 meshes separately with each of two smaller gears, 128 in 129, while gear 127 meshes separately with each of two other gears, 130 and 131, having the same pitch diameter as gears 128 and 129. The gears of the second stage are rotatably supported between the above-mentioned face of gear support 117 and the outer face 132 of slide plate 81. The second stage of the gear train of drive unit 16 is, in turn, coupled to a final stage thereof.

Figure 7:
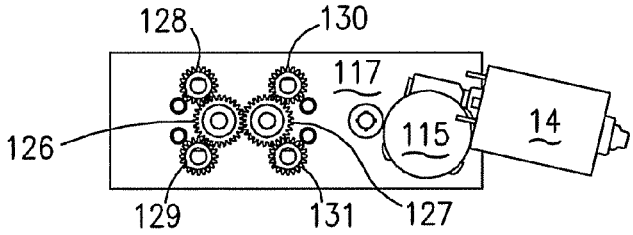
FIG. 7 is a rear view showing the final stage of the gear train of the drive unit of the appliance elevator of FIGS. 1, 2 & 3.

As shown in FIG. 7, the final stage of the gear train of drive unit 16 includes four gears, 135, 136, 137 and 138, which are rotatably supported between the rear face 133 of slide plate 81 on one side and a rack press plate 137 and a bearing plate 138 on their opposite side. The rack press plate 137 holds each of gears 135-138 in driving engagement with rack 87. Gears 135 and 136 are coupled to the output shafts of gears 128 and 129, respectively and engage rack face 90. Gears 137 and 138 are positioned on the opposing side of rack 87 to engage rack face 89. Gears 137 and 138 are coupled to the output shafts of gears 130 and 131, respectively of the second stage of the gear train of drive unit 16.

Referring particularly to FIGS. 1, 2 & 3, the installation of elevator apparatus 10 within furniture 22 will now be described in further detail. Elevator apparatus 10, with lift mechanism 12 already attached to mounting panel 26, is placed against the rear wall of furniture 22, centered or otherwise laterally positioned as desired and attached to furniture 22 using at least one, and preferably several fasteners 140. For convenience of illustration only, fasteners 140 are illustrated in FIG. 1 as screws. However, it is to be understood the term "fastener" is used herein and in the claims in its broadest sense and encompasses any item, apparatus or material capable of fastening two or more members and includes without limitation any combination or sub-combination of nails, staples, screws, bolts, nuts, clips, retainers, clamps, adhesives or any other suitably secure mode of attachment.

Once appliance elevator 10 is so attached to furniture 22, substantially the entire mechanical load represented by the lift mechanism 12 is transferred to furniture 22 by way of mounting panel mounting panel 26. When appliance elevator 10 is in use, that mechanical load includes not only the weight of lift mechanism 12, but also includes the weight of any appliance carried by lift mechanism 12 when in use. By positioning the fasteners 140 so they attach mounting panel 26 to furniture only at locations of sufficiently structurally sound members of furniture 22, it can be ensured that the mechanical load will be carried safely and without risk of damaging either appliance elevator 10 or furniture 22 either during shipping or use of the finished motion furniture product. One way to achieve such positioning is to provide mounting panel 22 with pre-formed holes or markings 145 in positions selected to correspond to such locations for the given particular model or models of furniture 22 in which appliance elevator 10 is to be installed.

In operation, after appliance elevator 10 has been installed in furniture 22 in the manner described above, AC power cable 68 is passed through an opening made or already provided for such purpose in furniture 22 and connected to a suitable AC power receptacle. The television or other appliance with which appliance elevator 10 is to be used is then placed on appliance support 15 and if appropriate, attached to horizontal support bar 93 to provide additional support and stability. After connecting any power or other cables associated with the appliance in the manner recommended by its manufacturer, and routing such cables by way of cable management system 114, appliance elevator 10 is ready for use. Appliance elevator 10 is energized using either a hand-held remote control device or by actuating power switch 107. Assuming appliance support 15 is initially positioned at storage position 19, actuating either switch 108 to its "down" position or pressing a functionally corresponding command button on a remote control unit, if one is provided, energizes motor 14 to rotate in a direction such that the gear train of drive unit 16 will rotate gears 135-138 so as to climb rack 87 until appliance support 15 reaches use position 24. If furniture 22 is the of a type having a hinged top 101, vertical arm 97 pushes the hinged top 101 open it as appliance support 15 rises. When use position 24 is reached, a limit switch or proximity switch is actuated by one of stops 111 causing motor 14 to be de-energized, thereby halting the travel of appliance support 15. At use position 24, the appliance carried on appliance support 15 is sufficiently clear of furniture 22 that the appliance can be used in its intended manner.

When the appliance it carries is not in use, the appliance support 15 can be lowered from use position 24 to storage position 19. Such action is initiated by either actuating switch 108 to its "down" position or pressing corresponding command button on a remote control unit, if one is provided. In response, motor 14 is energized and caused to rotate in a direction such that the gear train of drive unit 16 rotates gears 135-138 such that they descend rack 87 until appliance support 15 reaches storage position 19. When storage position 19 is reached, a limit switch or proximity switch is actuated by one of stops 111 causing motor 14 to be de-energized, thereby halting appliance support 15. The height of storage position 19 is preferably such and that the appliance carried by appliance support 15 is fully withdrawn into the interior cavity 21 of furniture 22. If furniture 22 is a type having a cover or lid, such as hinged top 101, such can then be closed in order to provide concealed storage of the appliance.

In view of the foregoing, it will be appreciated that the invention offers a number of advantages. First, during the construction of elevator apparatus 10 itself, mounting panel 26 serves as an unobstructed substrate upon which all or a substantial portion of lift mechanism 12 and its related controls can be efficiently assembled and mounted. Mounting panel 26 permits the lift mechanism 12 to assembled and tested for proper operation under favorable working conditions, free of the confined spaces, access and working room constraints and unfavorable lighting conditions commonly present within the interior cavity 21 of furniture 22, where little light or working space for either tools or human hands may be available. Moreover, any or all of him the foregoing operations can take place at a location other than the factory or assembly floor where furniture 22 is itself constructed. Ideally, appliance elevator 10 can be substantially fully assembled by its manufacturer and shipped to furniture makers for final installation by workers requiring no special skill or training in matters such as the assembly, wiring, or testing of lift mechanism 12.

Mounting panel 26 also facilitates the human handling of appliance elevator 10. The laterally extending portions 48, 51 of mounting panel 26 allow appliance elevator 10 to be conveniently grasped and handled in preparation for shipping, during shipping, during unpacking from shipping and most importantly, during the process of installing appliance elevator 10 within the interior cavity 21 of furniture 22. Handling and installation can readily be carried out by a single person and are even further aided by providing one or both extending portions 48, 51 with one or more hand openings 61 defining adjacent handle portions 64. The invention thus reduces the possibility of appliance elevator 10 being damaged as a result of handling by way of one of its more delicate or weaker members such as support bar 93.

Further, the one or more extending portions 48, 51 of mounting panel 26 provide freely accessible structure of adequate structural soundness for receiving fasteners for mechanically connecting elevator apparatus 10 to furniture 22 so that substantially the entire mechanical load on the lift mechanism 12 can be safely transferred to furniture 22 by way of mounting panel 26.

While the foregoing description sets forth a preferred embodiment of the invention and the best mode presently contemplated by the inventor for carrying out the invention, it is to be understood that the scope of the invention is not limited to any particular form described above since, in light of the above description, those skilled in the art will readily recognize modifications that can be made without departing from the scope of the invention as particularly pointed out and distinctly claimed in the appended claims, including all legal equivalents thereof. Without limiting the generality of the foregoing, it will be appreciated that while the preferred embodiment described above happens to include a lift mechanism 12 of the certain type described in detail above, the invention is not limited to an appliance elevator which includes that particular type of lift mechanism. In light of the present disclosure, persons of ordinary skill in the art will readily recognize that other types of lift mechanisms can be substituted without departing from the scope of the present invention. Non-limiting examples of such alternative lift mechanisms are those disclosed in, or variants of those disclosed in U.S. Pat. No. 4,151,804 to Wache; U.S. Pat. No. 6,733,094 to Chang; U.S. Pat. No. 6,611,670 to Liu; U.S. Pat. No. 5,797,666 to Park; U.S. Pat. Nos. 6,092,243 and 7,043,810 to Bober.

What is claimed is:

1. An appliance elevator apparatus installable within an interior cavity of a piece of furniture, the furniture being of the type having a rear wall and a hinged top, the hinged top being located above the interior cavity and being hinged to move relative the rear wall between an open position and a closed position, for supporting an appliance and for selectively (i) moving the hinged top from the closed position to the open position and raising the appliance from a storage position within the furniture to a use position and, (ii) lowering the appliance from the use position to the storage position, said apparatus, comprising:

a lift mechanism having an electric motor, an appliance support for supporting the appliance, and a drive unit mechanically interposed between said motor and said appliance support, said drive unit having a body to which said appliance support is coupled to move relative said body for selectively: (i) raising said appliance support along a line of travel from the storage position to the use position and, (ii) lowering said appliance support along said line of travel from the use position to the storage position, said drive unit being in a lowered position when said appliance support is in the storage position, said lift mechanism further having a component which is mechanically coupled to said drive unit to move with said appliance support; and a mounting panel which defines a mounting plane, said mounting panel having a front surface and an opposed rear surface, said lift mechanism in an at least substantially fully assembled form being affixed to said mounting panel with said body of said drive unit being attached in positionally-fixed relation to said front surface of said mounting panel such that said line of travel is oriented substantially parallel to said mounting plane, at least a portion of said mounting panel extending beyond said body of said drive unit in at least one direction oriented substantially perpendicular to said line of travel, said extending portion of said mounting panel being attachable to the rear wall of the furniture by way of at least one fastener to install said mounting panel and said lift mechanism within the interior cavity of the furniture such that substantially the entire mechanical load on said lift mechanism when the lift mechanism is in use is transferred to the furniture by way of said mounting panel and such that said component of said lift mechanism is capable of acting on the hinged top of the furniture to move the hinged top of the furniture from the closed position to the open position in response to said raising of said appliance support to the use position.

2. The apparatus of claim 1 wherein said extending portion of said mounting panel includes a handle portion which is at least partially disposed on said front surface and is positioned to be sufficiently accessible without obstruction by said lift mechanism when said lift mechanism is in said lowered position that said handle portion can be grasped by a human hand while said lift mechanism affixed to said panel is in said lowered position for manually maneuvering said panel member, and therefore also said lift mechanism attached to said panel member, into position within the cavity for installation of the elevator apparatus in the furniture, said handle portion comprising: at least one opening of sufficient size to permit grasping of said mounting panel by a human hand in an area adjacent the periphery of said opening.

3. The apparatus of claim 2 wherein said handle portion comprises a hand opening formed in said panel.

4. The apparatus of claim 3 wherein said hand opening penetrates said front surface of said mounting panel.

5. The apparatus of claim 3 wherein said hand opening penetrates said front surface and said rear surface of said mounting panel.

6. The apparatus of claim 1 wherein said mounting panel is formed substantially entirely from a unitary piece of sheet material.

7. The apparatus of claim 6 wherein said sheet material is a layered composite material.

8. The apparatus of claim 7 wherein said sheet material is plywood.

9. The apparatus of claim 6 wherein said sheet material is medium density fiberboard.

10. The apparatus of claim 1 wherein said drive unit comprises a drive unit which moves said appliance support along said line of travel by way of a path of movement which is linear.

11. The apparatus of claim 1 wherein said component comprises an aim having a roller.

12. An appliance elevator apparatus installable within an interior cavity of a piece of furniture, the furniture being of the type having a rear wall and a hinged top, the hinged top being located above the interior cavity and being hinged to move relative the rear wall between an open position and a closed position, for supporting an appliance and for selectively (i) moving the hinged top from the closed position to the open position and raising the appliance from a storage position within the furniture to a use position and, (ii) lowering the appliance from the use position to the storage position, said apparatus, comprising:

a lift mechanism having an electric motor, an appliance support for supporting the appliance, and a drive unit mechanically interposed between said motor and said appliance support, said drive unit having a body to which said appliance support is coupled to move relative said body for selectively: (i) raising said appliance support along a line of travel from the storage position to the use position and, (ii) lowering said appliance support along said line of travel from the use position to the storage position, said lift mechanism further having a component which is mechanically coupled to said drive unit to move with said appliance support; and a substantially planar mounting panel which defines a mounting plane, said body of said drive unit being attached in positionally-fixed relation to said mounting panel in an orientation such that said line of travel is oriented substantially parallel to said mounting plane, at least a portion of said mounting panel extending beyond said body of said drive unit in at least one direction oriented substantially perpendicular to said line of travel, said portion of said mounting panel being attachable to the rear wall of the furniture by way of at least one fastener to install said mounting panel and said lift mechanism within the interior cavity of the furniture such that substantially the entire mechanical load on said lift mechanism when the lift mechanism is in use is transferred to the furniture by way of said mounting panel and such that said component of said lift mechanism is capable of acting on the hinged top of the furniture to move the hinged top of the furniture from the closed position to the open position in response to said raising of said appliance support to the use position.

13. The apparatus of claim 12 wherein said mounting panel includes at least one hand opening of sufficient size to permit grasping of said mounting panel by a human hand in an area adjacent the periphery of said opening, said opening not projecting beyond a rear surface of said mounting panel said mounting panel having an outer edge located between a front side and a rear side, and said hand opening is located near said outer edge of said mounting panel.

* * * * *